US005315962A

United States Patent [19]

Renault et al.

[11] Patent Number: 5,315,962

[45] Date of Patent: May 31, 1994

[54] VALVES FOR A DUCT, AND TWO-STROKE COMBUSTION ENGINE INCORPORATING THE VALVES

[76] Inventors: Bernard A. Renault, 16 rue Nicolas Rayer, 93300 Aubervilliers; Pierre C. Brunetti, 179 rue du Ménil, 92600 Asnieres, both of France

[21] Appl. No.: 883,156

[22] Filed: May 14, 1992

[51] Int. Cl.[5] ..... F01L 7/00

[52] U.S. Cl. ..... 123/190.11; 123/65 V

[58] Field of Search ..... 123/65 V, 65 BA, 190.11, 123/190.1

[56] References Cited

U.S. PATENT DOCUMENTS 4,864,979 9/1989 Eickmann ..... 123/65 BA 4,995,354 2/1991 Morikawa ..... 123/65 V 5,081,961 1/1992 Paul et al. ..... 123/65 V

FOREIGN PATENT DOCUMENTS 627381 8/1949 United Kingdom .

2117047 10/1983 United Kingdom .

*Primary Examiner*—Noah P. Kamen

*Attorney, Agent, or Firm*—Charles E. Baxley

[57] ABSTRACT

Rotating valves are set forth especially for use in two stroke internal combustion engines. The valve has two rotating parts which come into tangential pseudocontact with each other. Each rotating part has a solid surface of revolution which closes off flow and a recessed portion which permits flow.

18 Claims, 10 Drawing Sheets

VALVES FOR A DUCT, AND TWO-STROKE COMBUSTION ENGINE INCORPORATING THE VALVES

BACKGROUND OF THE INVENTION

The present invention relates to a system for rapid closure and rapid opening of the fluid-flow cross-section of a duct and to the application of such a system to the rapid closure and rapid opening of the gas-inlet and/or -exhaust ducts in a two-stroke combustion engine.

These engines comprise at least one cylinder in which a reciprocating piston is housed, the said cylinder defining a combustion chamber in fluid communication with a fresh-gas inlet duct and a burnt-gas exhaust duct emerging in the said chamber, respectively, via at least one inlet port and at least one exhaust port, the said ports being capable of being closed by the piston according to its position in the cylinder. In practice, there are generally several inlet ports and a single exhaust port.

Such combustion engines have low thermodynamic efficiency, develop low maximum torque and are a source of pollution.

The cycle of this type of engine can be broken down as follows:

- explosion of the gases: the piston descends while the exhaust and inlet ports remain closed by the skirt of the piston;
- start of the exhaust phase when continuation of the descent of the piston causes opening of the exhaust port;
- start of the inlet phase when continuation of the descent of the piston causes opening of the inlet ports;
  - As of this instant and up to closure of the inlet ports following the ascent of the piston, the exhaust and inlet ports are open and in communication; this period may be broken down into two phases: first, there is scavenging of the residual burnt gases by the fresh gases, then filling of the cylinder with fresh gas.
- end of the inlet phase when the inlet ports are closed following the ascent of the piston;
- start of the compression phase of the fresh gases on closure of the exhaust port following continuation of the ascent of the piston.

It is the long crossover period during which the exhaust and inlet ports are open which gives the two-stroke engine its poor qualities in terms of torque, efficiency and pollution. In fact, a large part of the fresh gases is lost in the exhaust on scavenging, on inlet and during the time gap separating closure of the inlet ports from that of the exhaust port. In the case of engines equipped with an carburetor or an injection system in the inlet duct, the loss of efficiency and the rate of pollution are proportional to the amount of unburnt fuel lost.

Moreover, in this type of engine, compression begins only after closure of the exhaust port, the compression ratio is thus very low and filling at the start of compression is mediocre due to the losses. The engine torque is thus considerably restricted.

Moreover, during each cycle, the power stroke ends on opening of the exhaust port. The engine thus does not take advantage of all the expansion of the gases, it loses in terms of operational flexibility, combustion is aborted and a certain amount of unburnt gases is discharged into the exhaust, further aggravating the poor efficiency and the rate of pollution. It will also be noted that scavenging of the residual gases is incomplete and that the compressed gas mixture exhibits a certain content of gases burned during the preceding combustion. Propagation of the flame during combustion is impeded and thermodynamic efficiency diminished.

Numerous devices have been developed in order to attempt to rectify these defects. The object of all of them is to influence one or the other of the inlet and exhaust patterns so as to reduce losses of fresh gas and to improve filling of the cylinder.

These devices are based on three main principles:

- devices which modify the height of the exhaust port as a function of operating parameters;
- devices which modify exhaust tuning as a function of operating parameters, and
- devices which manage inlet timing and exhaust timing, defining the start and the end of their respective phases as a function of operating parameters.

Only those devices which are based on the latter of these three principles constitute a real response to the problem posed. There are numerous innovations in this field, but lack of efficiency means that genuine technical progress remains poor.

GB-A-2,117,047 MONTGOMERY also discloses a system for rapid closing and rapid opening of the fluid-flow cross-section of a duct, consisting of a pair of two rotating parts turning, in opposition, about parallel axes, the said rotating parts each defining a recessed surface of revolution, the said parts being guided in rotation so that, during the rotation of the said parts, their solid parts achieve tangential pseudocontact which totally closes off the duct, whose flow cross-section is then freed by the continuation of rotation of the parts bringing their recesses opposite one another, the said axes of rotation of the rotating parts being perpendicular to the longitudinal axis of the duct at the level of the said tangential pseudocontact.

"Pseudocontact" is understood to mean that a clearance (for example, of the order of 1/10 mm) is retained in order to account, in particular, for expansion of the parts.

The MONTGOMERY rotating parts are "blade" valves. Such blade valves, which are rotating parts comprising, principally, two recesses mutually defining a blade, do not permit asymmetric timing optimizing the pattern, that is to say do not permit opening and closing of the ducts at the right moment and thus do not make it possible to obtain optimum efficiency and reduced pollution.

SUMMARY OF THE INVENTION

The aim of the present invention is to remedy this drawback and the said aim is attained in that, in the system proposed, each rotating part comprises only a single recess.

Unlike the MONTGOMERY blade valves, the rotating parts according to the invention are more of the "slide-valve" type. The structural difference between MONTGOMERY and the invention, in addition to the fact that the latter permits the expected asymmetrical timing, is reflected in substantial differences in operation.

The circular shape of the rotating parts according to the invention and their reduced thickness do not cause disturbances in the duct by mixing of the gases, which occurs to a considerable degree with blade systems.

Moreover, the duration of closure of blade valves is very brief, even when turning at half engine speed, which in no way permits operation equivalent to the system used according to the invention.

In the system according to the invention, each rotating part is guided in rotation within the inner opposing walls of the duct and it is projected inside the latter.

In a preferred embodiment, the geometry and the dimensions of the recesses are such that their coming opposite one another is capable of totalling freeing the flow cross-section of the duct.

In the application to a two-stroke combustion engine, one at least of the said inlet and exhaust ducts is equipped, in immediate proximity to the said corresponding port or ports, with the system for rapid closure and rapid opening according to the invention and, preferably, each of the two ducts is equipped with such a system. The two pairs of rotating parts are continuously driven in rotation with suitable timing which will be described hereinbelow.

This structure improves the thermodynamic efficiency of the two-stroke engine by giving it an efficiency which is equal or superior to that of a four-stroke engine developing the same power. It reduces the level of pollution and makes it possible to supercharge the engine, thus multiplying its maximum torque. Equipped in this way, the two-stroke engine no longer exhibits the defects which distinguished it from the four-stroke combustion engine and it retains its individual advantages:

- small overall size;
- good mechanical reliability due to the reduction in the number of moving parts, such as valves, rocker arms, etc., and the dispensing of parts no longer covered by the definition of the engine, such as the cam shaft, timing chain, etc.;
- high specific power output; the cycle of this type of engine is twice as short as that of the four-stroke engine so, at the same speed, it executes twice as many power strokes and its power, for equal thermodynamic efficiency, is doubled.

The rotating parts of each pair come into tangential pseudocontact either against one another or against the opposing faces of an intermediate element having a leading end and a trailing end, seen in the direction of the flow of the fluid, the leading end being tapered to a point and the cross-section of the said intermediate element increasing from the leading end to the trailing end.

This shape of the intermediate element minimizes the flow loss caused by its presence in the duct.

When the rotating parts come into tangential pseudocontact against one another, they are cylindrical.

When the rotating parts come into tangential pseudocontact with the opposing faces of an intermediate element, it [sic] may be ovoid so as to match the perimeter of the cylinder and thus to reduce the dead volume which separates them from the inlet or exhaust ports. This thus reduces the effects of delays due to the compression of the gas column trapped at this location.

In a first embodiment, each of the said rotating parts consists of a curved part of small wall thickness which turns in a support and guide passage made between an inner casing wall and a shaft.

This shaft may be fixed or be mounted so as to oscillate in order to reduce the amplitude of the rotation of the curved part.

In both cases, a suitably profiled zone of the said shaft is capable of being integrated into the interior wall of the duct to the formation of which it contributes without interruption of curvature. This thus prevents the flow losses in the flow of the gases.

In a second, more economical, embodiment, the rotating parts are rotors.

When the engine is equipped with a turbocharger, it is advantageous for the rotating parts of the system for rapid closure and rapid opening of the exhaust duct to come into tangential pseudocontact with the opposing faces of an intermediate element which is extended, on the upstream side, seen in the direction of exhaust of the gases and from the tangential points of contact, substantially as far as the exhaust port, and, on the downstream side, as far as a partition dividing the duct into a lower branch and an upper branch, the lower branch being connected to the actual exhaust and the upper branch being connected to the said turbocharger.

The intermediate element may be mounted so as to oscillate about an axis passing through its trailing end so as to be able to select two possible orientations of the leading end of the said element, and, thus, a longer turbocharger pressure feed time at low speeds and a shorter pressure feed time at high speeds.

The pair of rotating parts of the system for rapid opening and rapid closure of the inlet duct and the pair of rotating parts of the system for rapid opening and rapid closure of the exhaust duct are preferably driven in rotation by non-interdependent means. It is thus possible to achieve variable timing of the two pairs of rotating parts. Closing-off of the inlet and exhaust ducts and control of the corresponding patterns become all the more versatile.

BRIEF DESCRIPTION OF THE DRAWINGS

The invention will be better understood on reading the following description which is given with reference to the appended drawings, in which.

DETAILED DESCRIPTION OF THE INVENTION

Figure 1:
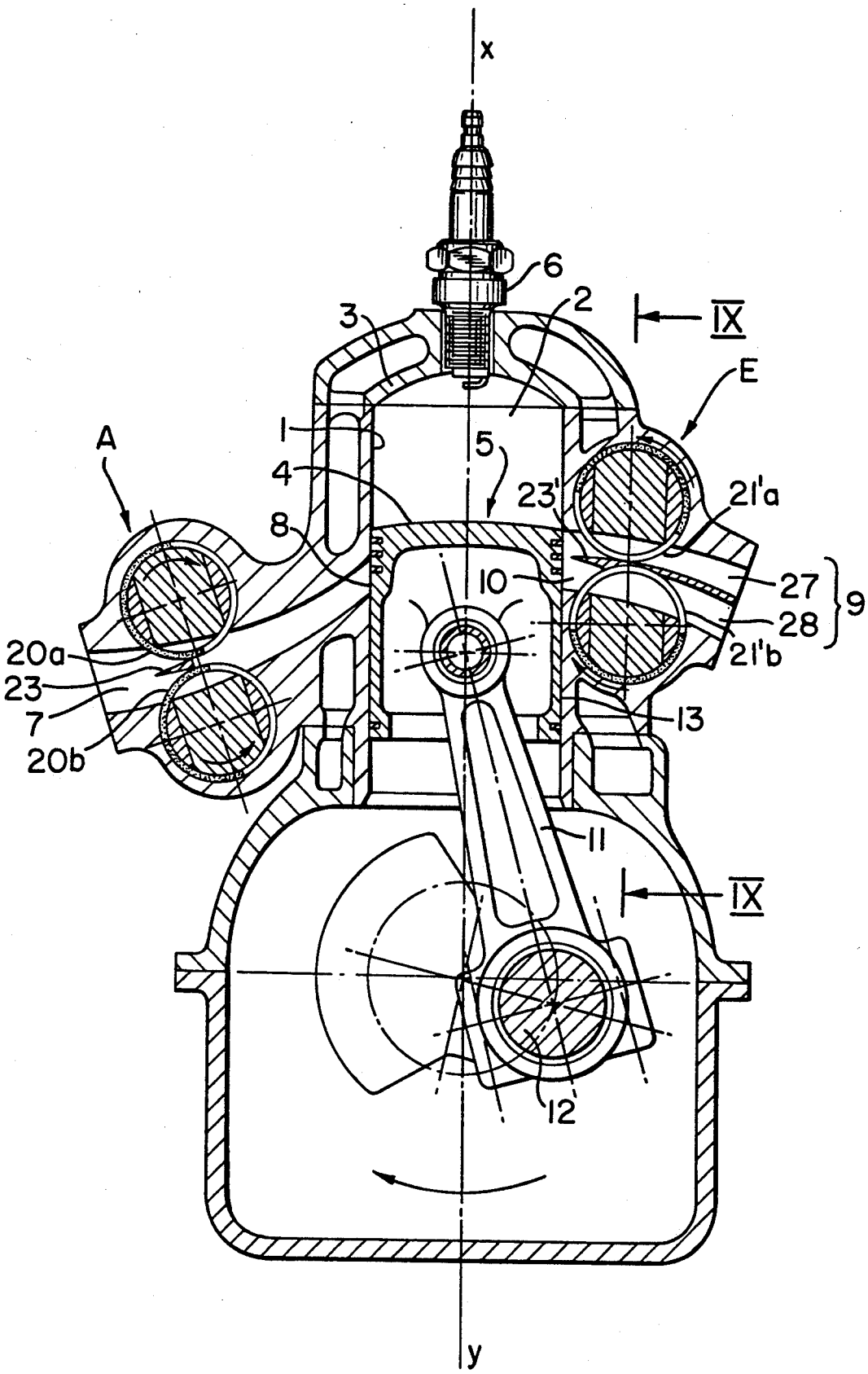
- FIGS. 1 to 6 show, in longitudinal section, a two-stroke combustion engine equipped with the systems for rapid opening and rapid closure according to the invention, in its different operational phases, the said section passing through the median plane of a cylinder.
Figure 2:
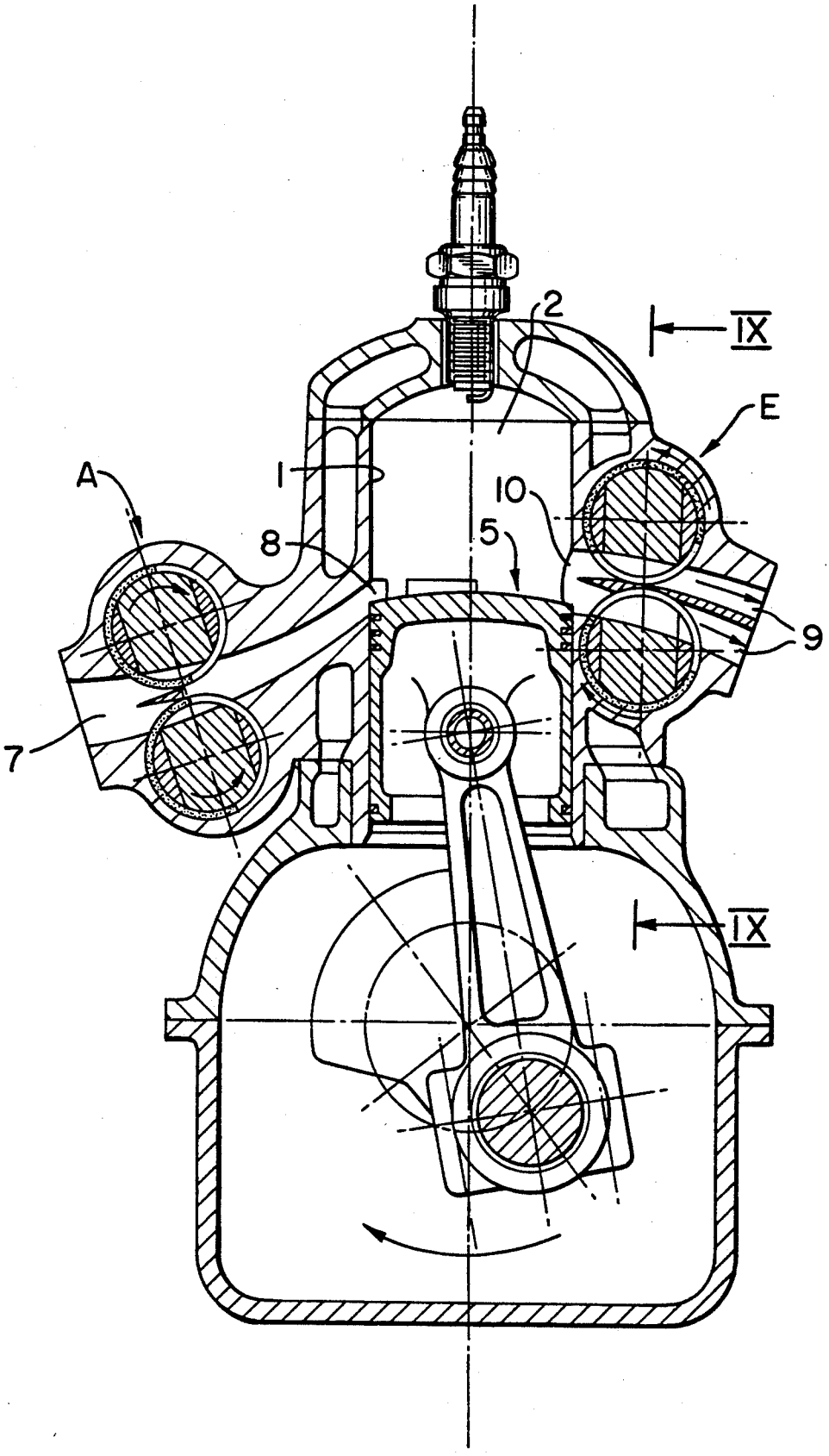
Figure 3:
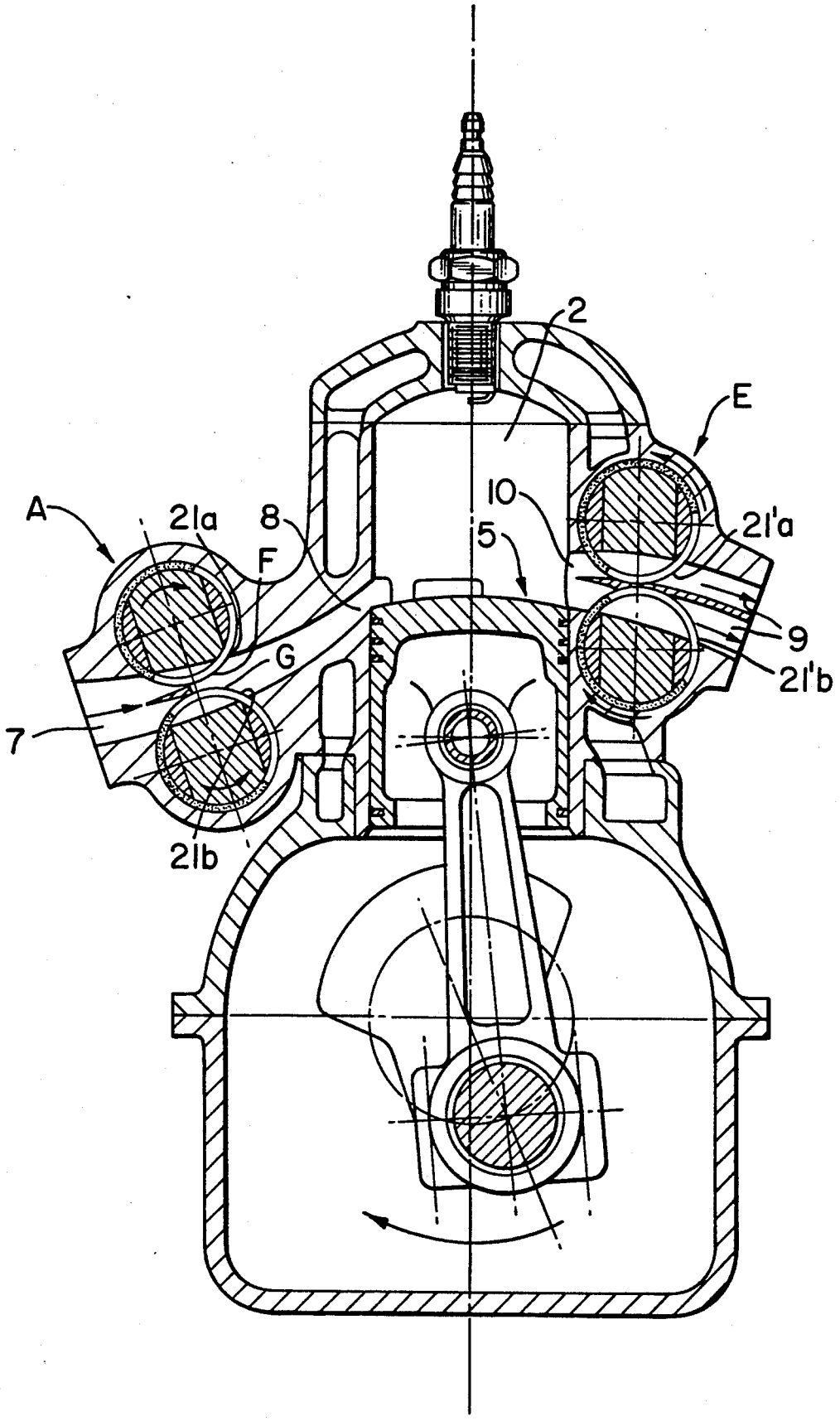
Figure 4:
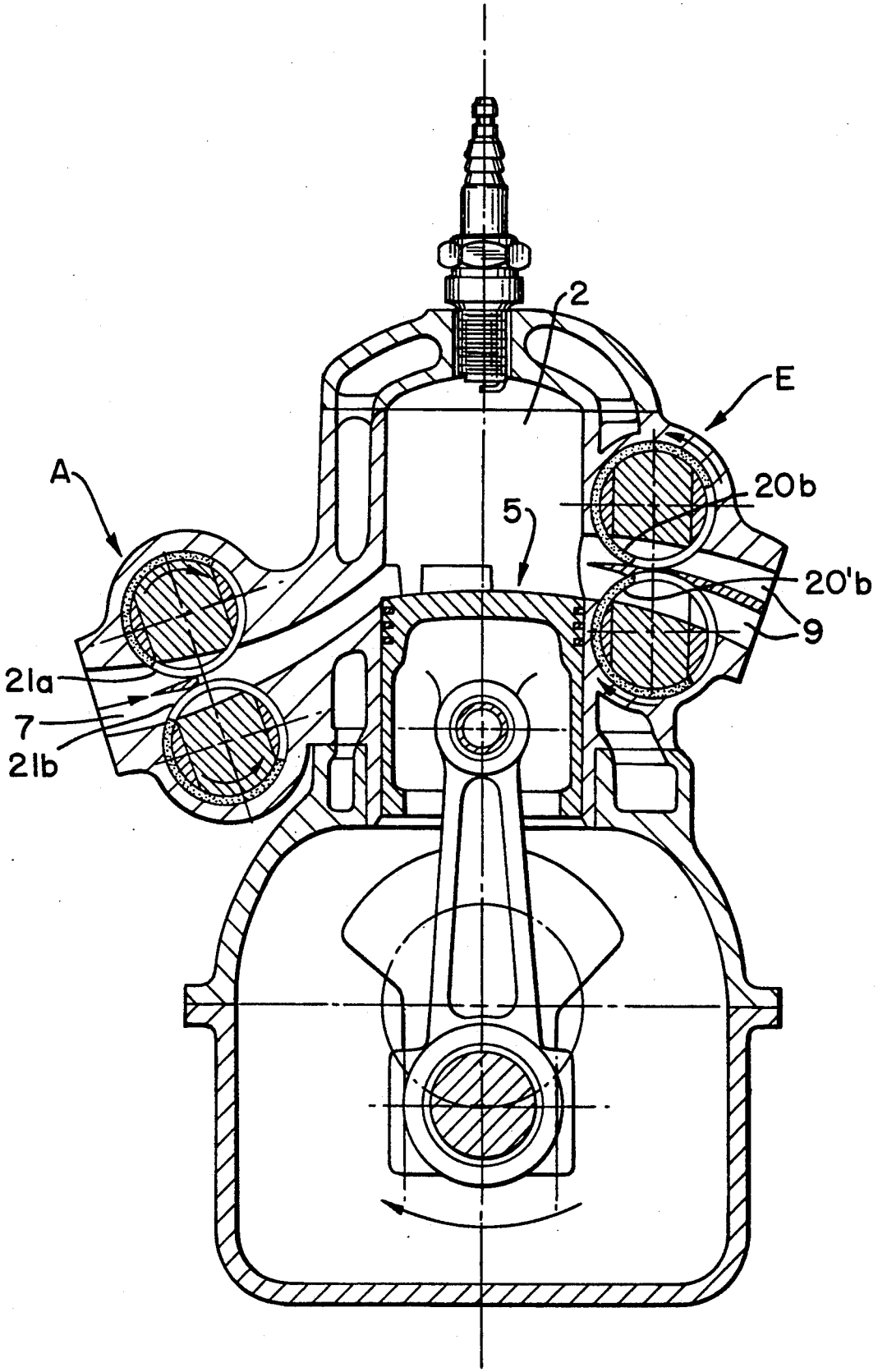
Figure 5:
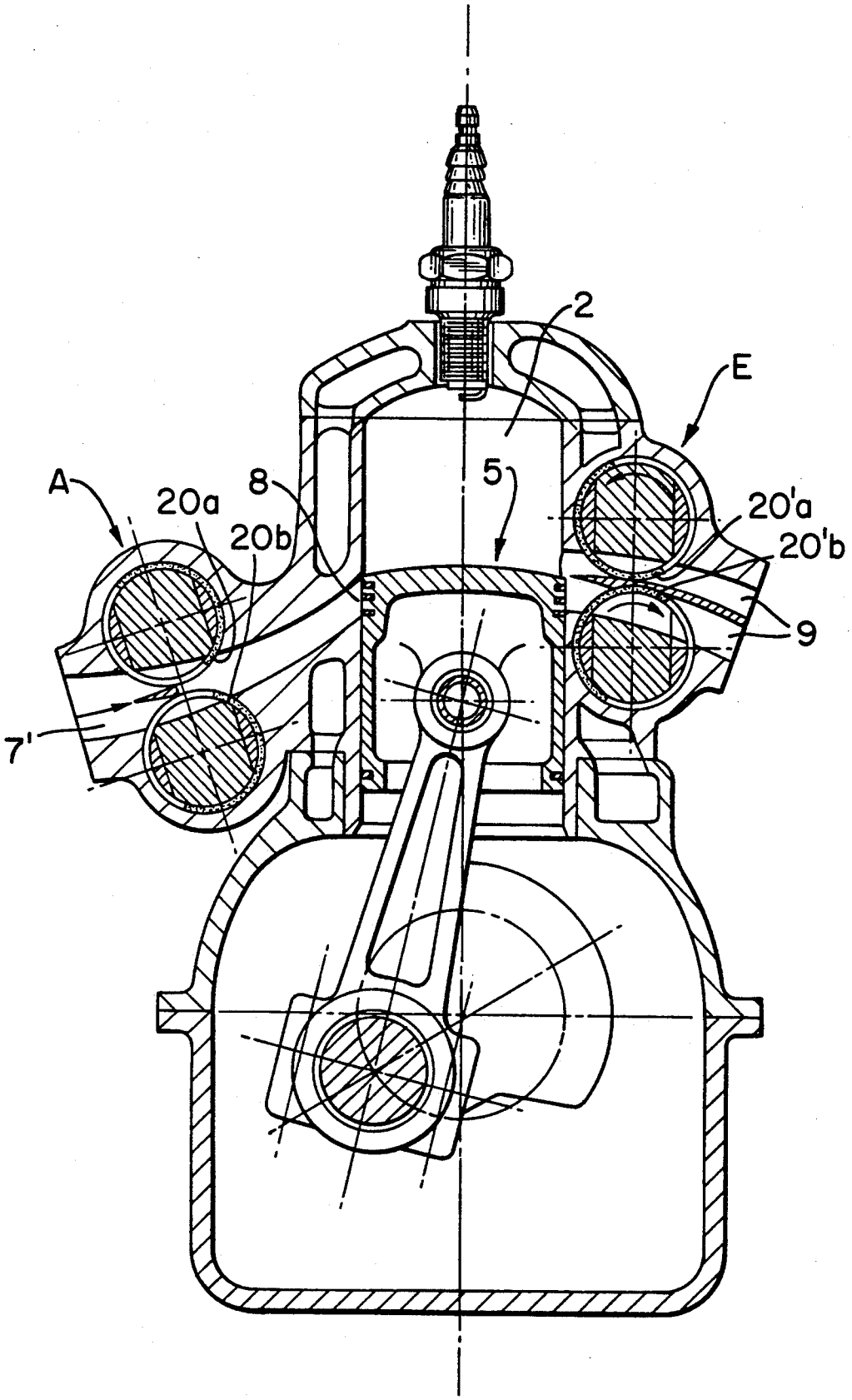
Figure 6:
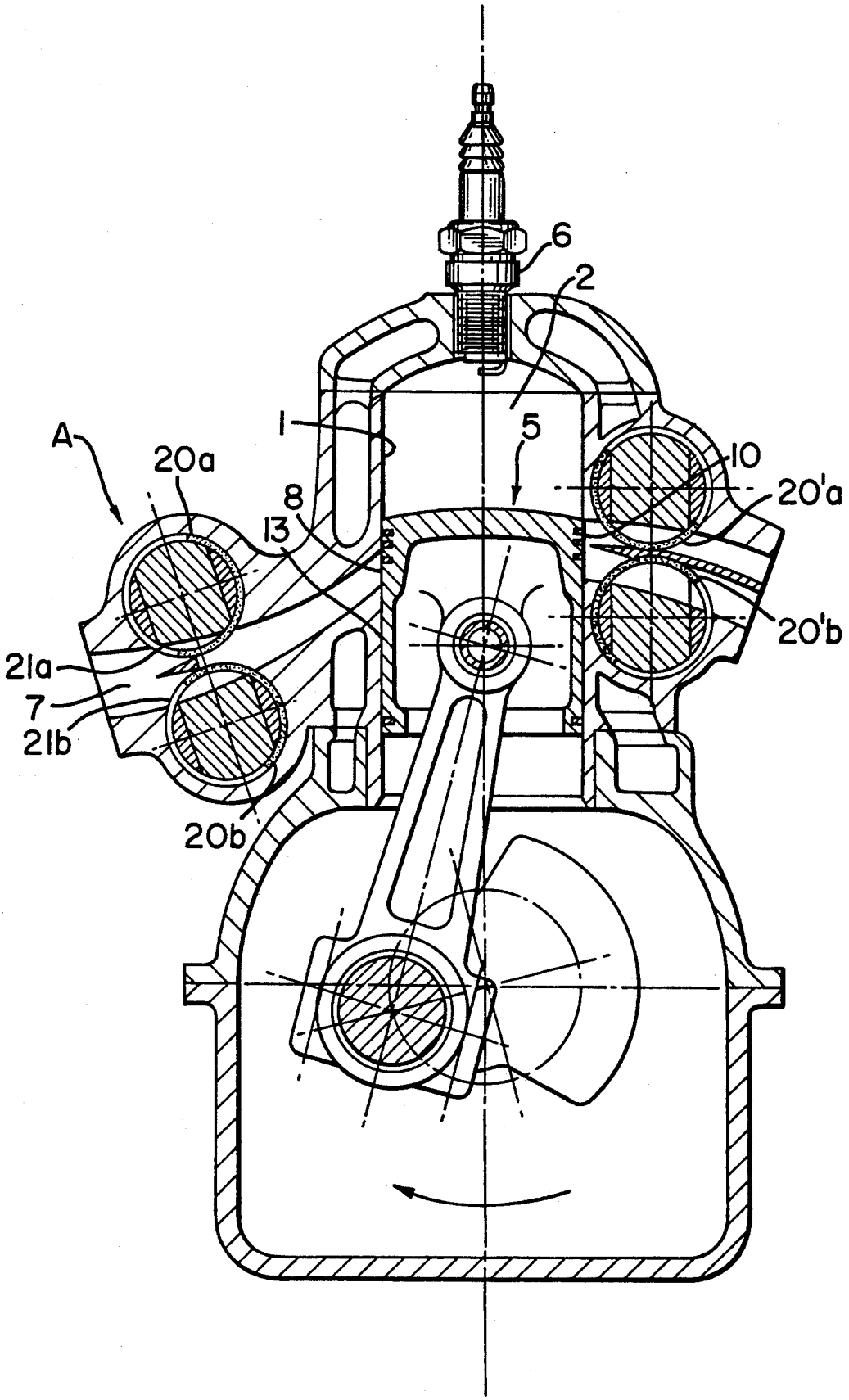

If reference is made to FIGS. 1 to 9, a two-stroke combustion engine will be seen, which is supercharged and comprises a cylinder 1 of axis x-y, defining a combustion chamber 2 delimited at its upper part by a cylinder head 3 and at its lower part by the bearing face 4 of a piston 5 mounted in a reciprocating manner. A sparkplug 6 is mounted in the cylinder head 3. A fresh-gas inlet duct 7 emerges in the cylinder 1 via inlet ports 8 while a burnt-gas exhaust duct 9 emerges in the cylinder 1 via an exhaust port 10. The piston 5 is connected via a connecting rod 11 to a crankshaft 12 and the condition of closure or opening of the ports 8 and 10 depends on the position of the piston 5 in the cylinder 1, the skirt 13 of the piston 5 being capable of closing them off. The structure described up to this point, is, of course, conventional.

According to the invention, the inlet duct 7 is equipped with a system for rapid closure and rapid opening, denoted overall by "A" and the exhaust duct 9 is equipped with a system for rapid closure and rapid opening denoted overall by "E".

Figure 7:
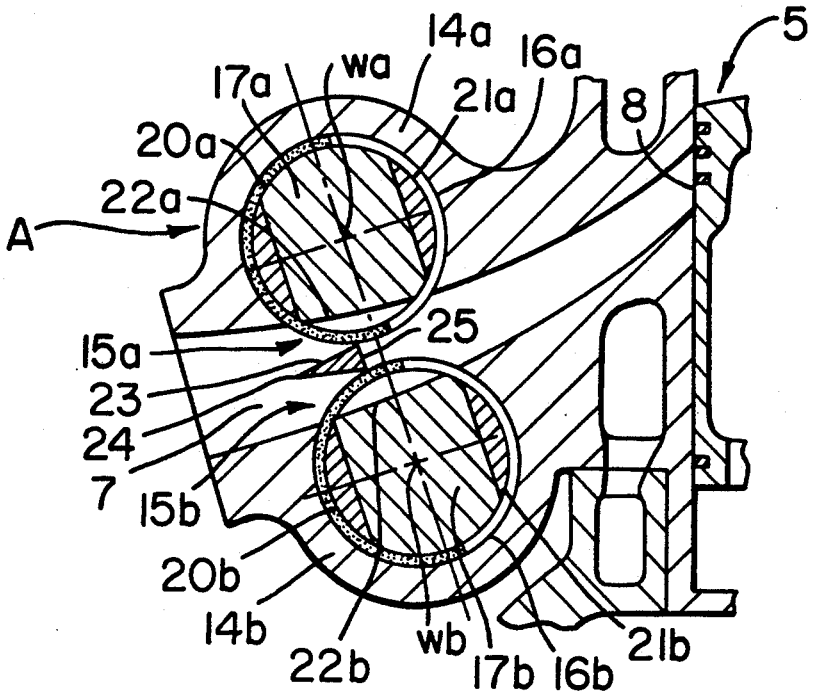
- FIG. 7 is a view on a larger scale of the system for rapid closure and rapid opening of the inlet duct in FIG. 1.

If FIG. 7 is examined, it will be seen that the upper part of the wall of the inlet duct 7 exhibits a bulge which serves as a casing 14*a* for a curved part 15*a* mounted rotatably about an axis wa in a passage 16*a* made between this casing 14*a* and a fixed shaft 17*a*. The rotating curved part 15*a* comprises a solid part 20*a* and a recess 21*a*, which solid part and recess are capable of substantially intersecting, revolution by revolution, the inner half-cross-section of the duct 7. The fixed shaft 17*a* has a suitably profiled cutout 22*a* in order not to introduce any interruption of curvature into the inner wall of the said duct 7 to the formation of which it contributes.

In the lower part of the inlet duct 7, opposite the structure 14*a*–22*a* described above, is an identical structure 14*b*–22*b* whose rotating part 15*b* turns about an axis wb. The axes wa and wb are mutually parallel.

As emerges from FIGS. 1 to 9, a median intermediate element 23 separates the duct 7 into an upper half and a lower half, upstream—seen in the direction of flow of the fresh gases—of the curved parts 15*a*, 15*b*, and in the immediate vicinity of the latter. This median element 23 has an upstream, or leading, end 24, tapered to a point, and a downstream, or trailing, end 25, the cross-section of the element 23 increasing from the leading end 24 to the trailing end 25. During their rotation in opposition, the solid parts 20*a* and 20*b* of the curved parts 15*a* and 15*b* come into tangential pseudo-contact with the opposing faces of the intermediate element 23 which has, to this end, suitable bores which are indicated, on the corresponding part 23' in FIG. 8, by the references 23'*a*, 23'*b*.

Figure 8:
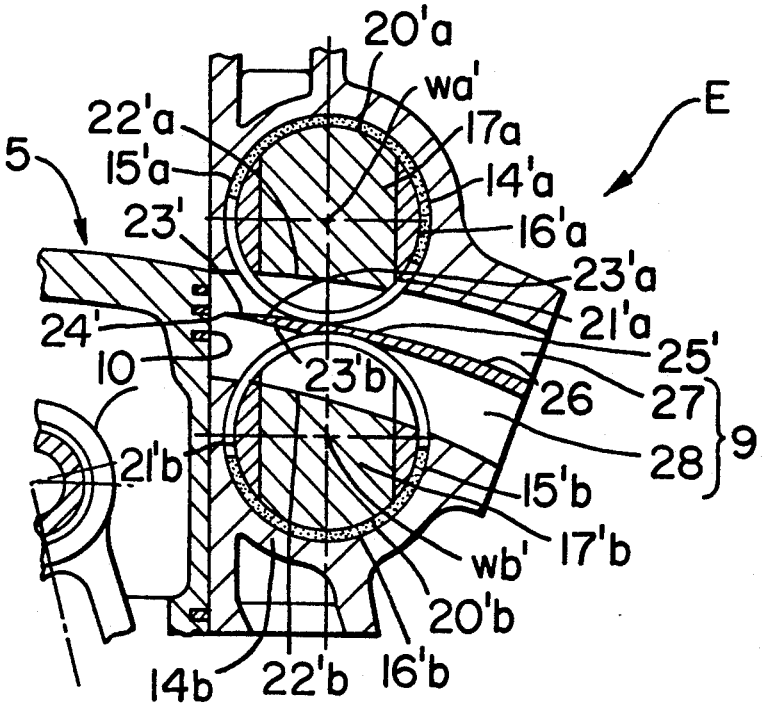
- FIG. 8 is a view on a larger scale of the system for rapid closure and rapid opening of the exhaust duct in FIG. 1.

An identical structure is provided in the exhaust duct 9 and the corresponding parts are denoted by the same references followed by the "prime" sign (FIG. 8). However, it will be seen that, on the exhaust side, the 14*a*'–2-2*a*'/14*b*'–22*b*' assembly (system E) is located much closer to the exhaust port 10 than the 14*a*–22*a*/14*b*–22*b* assembly (system A) is from the inlet ports 8. Moreover, the leading end 24' of the intermediate element 23' almost reaches the exhaust port 10 and a partition 26 follows the trailing end 25' of the said element 23'. This partition 26 divides the exhaust duct 9 into an upper half-duct 27 and a lower half-duct 28. The upper-half duct 27 is connected to a turbocharger, not shown, while the lower half-duct 28 is connected to the actual exhaust.

Figure 9:
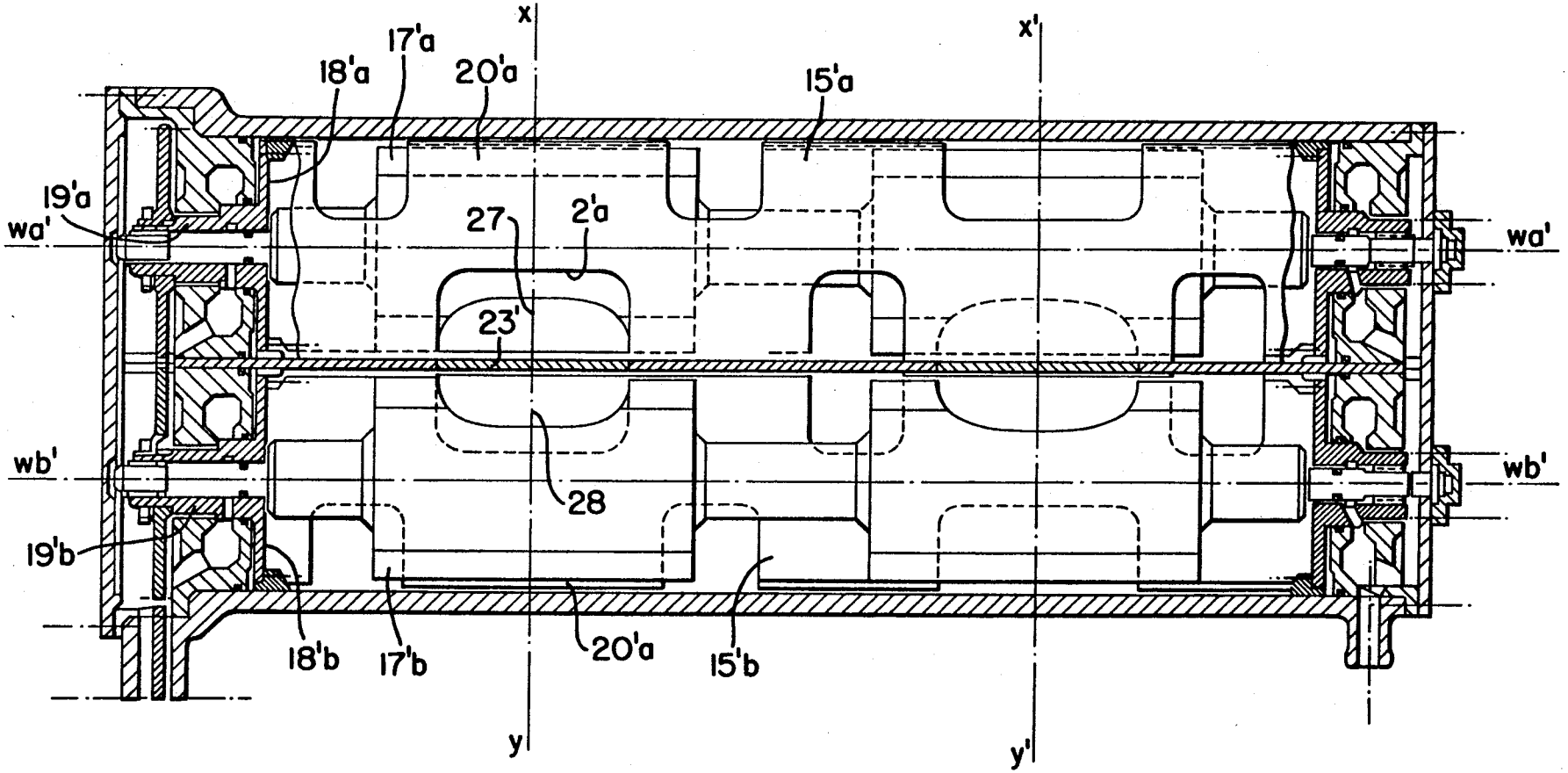
- FIG. 9 is a section taken along the line IX—IX in FIG. 1.

As will be seen from FIG. 9, the ends of the curved part 15'*a* are connected to a flange 18'*a* integral with a sleeve 19'*a* driven in rotation by appropriate means about the axis wa'—wa' of the fixed shaft 17'*a*. FIG. 9 also shows the presence of an identical structure for a second cylinder of axis x'–y'.

The curved parts 15*a*–*b* of the assembly A and those 15'*a*–*b* of the assembly E are continuously driven in rotation and they are timed so that they open and close their respective ducts 7 and 9 at appropriate moments chosen as a function of the position of the piston 5 in the cylinder 1.

More precisely, on the basis of a stage in which:

the solid parts 20*a* and 20*b* of the curved parts 15*a* and 15*b* are in tangential pseudocontact with the opposing faces of the intermediate element 23 (inlet duct 7 closed off by the system A according to the invention), while the recesses 21*a*' and 21*b*' of the curved parts 15*a*' and 15*b*' are opposite one another (exhaust duct 9 left wide open by the system E according to the invention), the operating cycle of the engine shown in FIGS. 1 to 9 is as follows:

(FIG. 1) after explosion, the gases expand and the piston 5 descends in the cylinder 1; as soon as the position of the piston 5 is such that opening of the exhaust port 10 ensues, the burnt gases are discharged via the exhaust duct 9 which is free of any obstacle;

(FIG. 2) the piston 5 continues its descent in the cylinder 1 and opens the inlet ports 8, but the inlet duct 7 is closed off by the system A so that no fresh gas is introduced into the cylinder; during this phase, the system E undertakes closure of the exhaust duct 9 while the burnt gases continue to flow;

(FIG. 3) the piston 5 continues its descent while the systems A and E, respectively, begin to open the inlet duct 7 and continue closure of the exhaust duct 9: this is the scavenging period of the burnt gases;

(FIG. 4) the piston 5 is in a position close to bottom dead center, while the systems A and E, respectively, leave the inlet duct 7 totally wide open and totally close the exhaust duct 9: this is the start of the fresh-gas inlet period;

(FIG. 5) the piston 5 ascends, closing the inlet ports 8 on passing: this is the start of the compression period; the system A simultaneously begins to close the inlet duct 7;

(FIG. 6) the piston 5 continues its ascent and closes the exhaust port 10 in passing, while the inlet duct 7 is now totally closed off by the system A, (this being in order to prevent any leakage of fresh gas towards the bottom of the engine between the skirt 13 of the piston 5 and the cylinder 1); the compression phase continues until the explosion triggered by the electric arc of the sparkplug 6.

It will be seen that the timing of the rotating parts 15'*a*–*b* of the assembly E, managing the exhaust-gas flow, is such that the start of closure of the exhaust duct 9 by the said parts 15'*a*–*b* comes into operation at a specific moment (FIG. 2) during the phase of opening of the exhaust port 10. The developed length of the solid part of the parts 15'*a*–*b* is such that, as of the moment (FIG. 4) when they have closed the exhaust duct 9, they hold it in this condition until closure of the exhaust port 10 (FIG. 6) by the piston 5.

The timing of the rotating parts 15*a*–*b* of the assembly A, managing the inlet-gas flow, is such that the start of closure (FIG. 5) of the inlet duct 7 by the said parts 15'*a*–*b* comes into operation at the moment of closure of the inlet ports 8 by the piston, so as to prevent, as of this instant and until reopening of the duct (FIGS. 2 and 3), any leakage of fresh gas, originating from the inlet duct, towards the bottom of the engine between the skirt 13 of the piston 5 and the cylinder 1. The developed length of the solid part of the parts 15*a–b* is such that, as of the moment when they have closed the inlet duct 7 (FIG. 6), they hold it in this condition until a specific moment during the opening phase (FIGS. 2 and 3) of the inlet ports 8 by the piston 5.

Figure 10:
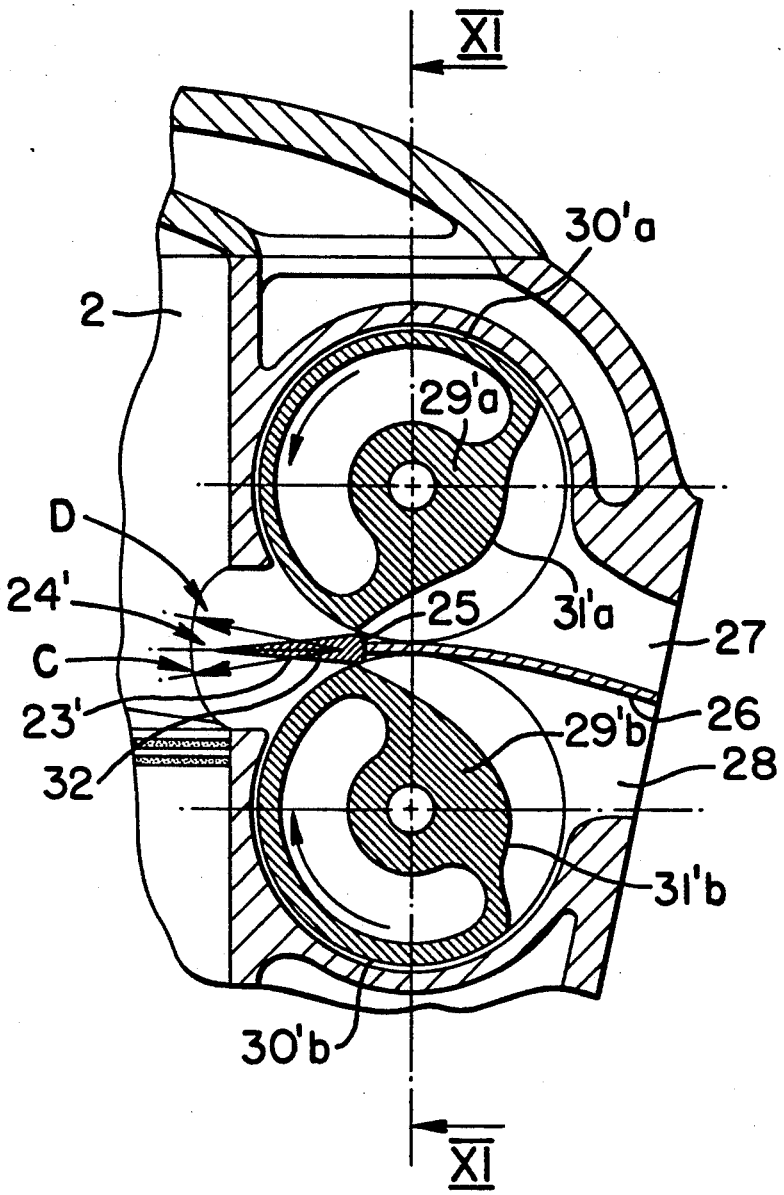
- FIG. 10 is a detail view of an alternative embodiment of a system for rapid opening and rapid closure of the exhaust duct.
Figure 11:
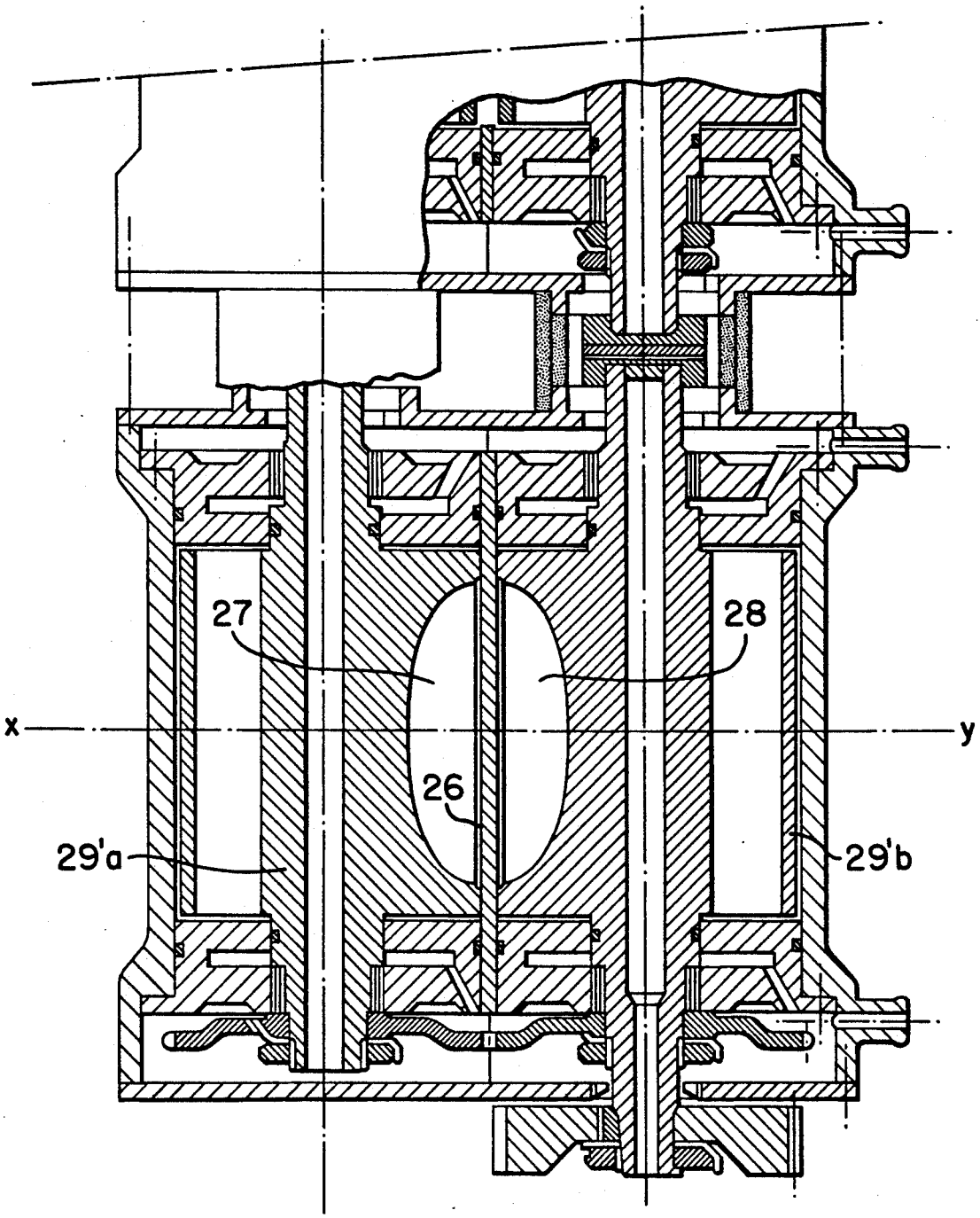
- FIG. 11 is a section taken along the line XI—XI in FIG. 10.

If FIGS. 9 and 10 are examined, it will be seen that, in an alternative embodiment, the curved parts 15*a–b*/15'*a–b* and their shaft 17*a–b*/17'*a–b* may be replaced, in more economical version, by rotors 29'*a–b* having a surface curved as a portion of a circle 30'*a–b* fulfilling the same function as the solid parts 20*a–b*/20'*a–b* and a recessed part 31'*a–b* fulfilling the same function as the recesses 21*a–b*/21'*a–b*. It emerges from FIG. 8 that the trailing end 25 of the intermediate element 23' is traversed by a pivoting spindle 32 which makes it possible to give two extreme orientations to the leading end 24' of the said element, namely an orientation pointing at C, permitting a longer turbocharger pressure feed time at low rotational speeds of the engine, then an orientation pointing towards D for high speeds.

It is, of course, understood that the invention is not limited to the embodiments which have been described and shown. In particular, instead of being cylindrical, the rotating parts could be ovoid. Instead of being fixed, the shafts 17*a–b*, 17'*a–b* could be oscillating, as shown by the broken lines ending at points F and G in FIG. 3, this being in order to accelerate the fresh-gas speed while limiting filling, with satisfactory scavenging at low engine speeds.

We claim:

1. A system for rapid closing and rapid opening of a fluid-flow cross-section of a duct, consisting of a pair of two rotating parts turning in opposition about parallel axes, said rotating parts each having a recessed surface of revolution defining a recess and further having a solid surface of revolution, said parts being guided in rotation so that during the rotation of said parts their solid surfaces of revolution achieve tangential pseudocontact which totally closes off said duct, whose flow cross-section is then freed by the continuation of rotation of said parts bringing their said recesses opposite one another, said parallel axes of rotation of the rotating parts being perpendicular to a longitudinal axis of the duct at the level of said tangential pseudocontact, characterized in that each of said rotating parts comprises only a single of the recesses.

2. The system according to claim 1, characterized further in that each of the rotating parts is guided in rotation within an opposing inner wall of the duct and in that each of the rotating parts is projected inside its respective said opposing inner wall.

3. The system according to claim 1, characterized further in that the rotating parts come into tangential pseudocontact against opposite faces of an intermediate element having a leasing end and a trailing end, seen in a direction of flow of the fluid, the leading end being tapered to a point and the cross-section of said intermediate element increasing from the leading end to the trailing end.

4. The system according to claim 1, characterized further in that the rotating parts are cylindrical.

5. The system according to claim 1, characterized further in that the rotating parts are ovoid.

6. The system according to claim 1, characterized further in that geometry and dimensions of the recesses are such that their coming opposite one another is capable of totally freeing the flow cross-section of the duct.

7. The system according to claim 1, characterized further in that each of said parts consists of a curved part of small wall thickness which turns in a support and guide passage made between an inner casing wall and a shaft.

8. The system according to claim 1, characterized further in that each of said parts consists of a curved part of small wall thickness which turns in a support and guide passage made between an inner casing wall and a fixed shaft.

9. The system according to claim 1, characterized further in that each of said parts consists of a curved part of small wall thickness which turns in a support and guide passage made between an inner casing wall and a shaft mounted so that the shaft oscillates.

10. The system according to claim 1, characterized further in that the geometry and dimensions of the recesses are such that their coming opposite one another is capable of totally freeing the flow cross-section of the duct and in that a suitably profiled zone of said shaft is capable of being integrated into the interior wall of the duct to the formation of which it contributes without interruption of curvature.

11. The system according to claim 1, characterized further in that said rotating parts are rotors.

12. A two-stroke combustion engine comprising at least one cylinder in which a reciprocating piston is housed, said cylinder defining a combustion chamber in fluid communication with a fresh-gas inlet duct and a burnt-gas exhaust duct emerging in said chamber respectively via at least one inlet port and at least one exhaust port, said ports being capable of being closed by the piston according to its position in the cylinder; the engine characterized in that at least one of said ducts is equipped in immediate proximity of its related said port with the system for rapid closure and rapid opening according to claim 1.

13. A two-stroke combustion engine comprising at least one cylinder in which a reciprocating piston is housed, said cylinder defining a combustion chamber in fluid communication with a fresh-gas inlet duct and a burnt-gas exhaust duct emerging in said chamber respectively via at least one inlet port and at least one exhaust port, said ports being capable of being closed by the piston according to it position in the cylinder, the engine characterized further in that each of the two ducts is equipped in immediate proximity to its related said port with the system for rapid closure and rapid opening according to claim 1 and in that the rotating parts are continuously driven in rotation with appropriate mutual timing.

14. A two-stroke combustion engine comprising at least one cylinder in which a reciprocating piston is housed, said cylinder defining a combustion chamber in fluid communication with a fresh-gas inlet duct and a burnt-gas exhaust duct emerging in said chamber respectively via at least one inlet port and at least one exhaust port, said ports being capable of being closed by the piston according to its position in the cylinder, the engine characterized further in that each of the two ducts is equipped in immediate proximity to its related said port with the system of rapid closure and rapid opening according to claim 1 and in that the rotating parts are continuously driven in rotation with mutual timing such that the start of closure of said exhaust duct by the said parts comes into action at a chosen moment in the opening phase of said exhaust port and in that the developed length of the solid part of said rotating parts is such that as of the instant when they have closed the exhaust duct they hold it in this condition until closure of the exhaust port by the piston.

15. A two-stroke combustion engine comprising at least one cylinder in which a reciprocating piston is housed, said cylinder defining a combustion chamber in fluid communication with a fresh-gas inlet duct and a burnt-gas exhaust duct emerging in said chamber respectively via at least one inlet port and at least one exhaust port, said ports being capable of being closed by the piston according to it position in the cylinder, characterized further in that each of the two ducts is equipped in immediate proximity to said port with the system for rapid closing and rapid opening according to claim 1, in that the rotating parts are continuously driven in rotation with mutual timing such that the start of closure of said inlet duct by said parts comes into operation at the moment of closure of said inlet port by the piston, the developed length of the solid part of said rotating parts being such that as of the moment when they have closed the inlet duct they hold it in this condition until a chosen moment in the opening phase of the inlet port by the piston.

16. A two-stroke combustion engine equipped with a turbocharger and comprising at least one cylinder in which a reciprocating piston is housed, said cylinder defining a combustion chamber in fluid communication with a fresh-gas inlet duct and a burnt-gas exhaust duct emerging in said chamber respectively via at least one inlet port and at least one exhaust port, said ports being capable of being closed by the piston according to its position in the cylinder; the engine characterized in that the exhaust duct it equipped in immediate proximity to said exhaust port with the system for rapid closure and rapid opening according to claim 1, and in that the rotating parts equipping said exhaust duct come into tangential pseudocontact with opposing faces of an intermediate element which is extended on the upstream side seen in the direction of exhaust of the gases from the points of tangential pseudocontact substantially as far as the exhaust port, and on the downstream side as far as a partition dividing the duct into a lower branch and an upper branch, the lower branch being connected to the actual exhaust and the upper branch being connected to the said turbocharger.

17. A two-stroke combustion engine equipped with a turbocharger and comprising at least one cylinder in which a reciprocating piston is housed, said cylinder defining a combustion chamber in fluid communication with a fresh-gas inlet duct and a burnt-gas exhaust duct emerging in said chamber respectively via at least one inlet port and at least one exhaust port, said ports being capable of being closed by the piston according to its position in the cylinder; the engine characterized in that the exhaust duct is equipped in immediate proximity to said exhaust port with the system for rapid closure and rapid opening according to claim 1, and in that the rotating parts equipping said exhaust duct come into tangential pseudocontact with the opposing faces of an intermediate element having a leading end and a trailing end, said element being mounted so as to oscillate about an axis passing through its trailing end and extending on the upstream side seen in the direction of exhaust of the gases from the points of tangential pseudocontact substantially as far as the exhaust port, and on the downstream side as far as a partition dividing the duct into a lower branch and an upper branch, the lower branch being connected to the actual exhaust and the upper branch being connected to the said turbocharger.

18. The two-stroke combustion engine comprising at least one cylinder in which an alternating piston is housed, said cylinder defining a combustion chamber in fluid communication with a fresh-gas inlet duct and a burnt-gas exhaust duct emerging in said chamber respectively via at least one inlet port and at least one exhaust port, said ports being capable of being closed by the piston according to its position in the cylinder, characterized in that each of the two ducts is equipped, in immediate proximity to said ports, with the system for rapid closure and rapid opening according to claim 1, and in that the pair of rotating parts of the system for rapid closure and opening of the inlet duct and the pair of rotating parts of the system for rapid opening and rapid closure of the exhaust duct are continuously driven in rotation, by noninterdependent means, with appropriate mutual timing.

* * * * *